US010227910B2

(12) United States Patent
Kaneko et al.

(10) Patent No.: US 10,227,910 B2
(45) Date of Patent: Mar. 12, 2019

(54) COOLING DEVICE AND COOLING METHOD FOR ENGINE

(71) Applicant: TOYOTA JIDOSHA KABUSHIKI KAISHA, Toyota-shi (JP)

(72) Inventors: Rihito Kaneko, Miyoshi (JP); Noboru Takagi, Toyota (JP); Isao Takagi, Okazaki (JP); Hidetoshi Onoda, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/264,221

(22) Filed: Sep. 13, 2016

(65) Prior Publication Data

US 2017/0074153 A1 Mar. 16, 2017

(30) Foreign Application Priority Data

Sep. 15, 2015 (JP) ..... 2015-182045

(51) Int. Cl.

| | |
|---|---|
| ***F01P 7/16*** | (2006.01) |
| ***F01P 5/10*** | (2006.01) |
| ***F01P 3/20*** | (2006.01) |
| ***F01P 11/20*** | (2006.01) |
| *F01P 7/14* | (2006.01) |

(52) U.S. Cl.

CPC ..... *F01P 7/165* (2013.01); *F01P 3/20* (2013.01); *F01P 5/10* (2013.01); *F01P 11/20* (2013.01); *F01P 2007/146* (2013.01); *F01P 2031/30* (2013.01); *F01P 2037/00* (2013.01); *F01P 2060/08* (2013.01)

(58) Field of Classification Search

CPC .... F01P 2007/146; F01P 7/14; F01P 2023/08; F01P 2031/30; F01P 2037/00

See application file for complete search history.

(56) References Cited

U.S. PATENT DOCUMENTS

| | | | | |
|---|---|---|---|---|
| 6,568,356 | B1 * | 5/2003 | Hayakawa | F01P 7/167 123/41.1 |
| 6,688,333 | B2 * | 2/2004 | McLane | B60H 1/00485 123/41.1 |
| 6,745,726 | B2 * | 6/2004 | Joyce | F01P 7/164 123/41.1 |
| 6,920,845 | B2 * | 7/2005 | Lelkes | F01P 7/167 123/41.01 |

(Continued)

FOREIGN PATENT DOCUMENTS

| | | |
|---|---|---|
| JP | 2013-124656 A | 6/2013 |
| JP | 2014-201224 A | 10/2016 |

*Primary Examiner* — Long T Tran

(74) *Attorney, Agent, or Firm* — Oblon, McClelland, Maier & Neustadt, L.L.P.

(57) ABSTRACT

A cooling device for an engine includes a radiator route passing through a radiator, that are merged together after being branched on the downstream side from the inside of the engine in a coolant circuit configured to allow a coolant to flow from a pump through the inside of the engine and return to the pump. An at-stop control section provided in the cooling device controls a multiway valve that has three discharge ports, including a radiator port connected to the radiator route, so as to close the radiator port and open at least one of the other discharge ports when an ignition switch is turned off.

6 Claims, 5 Drawing Sheets

(56) References Cited

U.S. PATENT DOCUMENTS

| | | | | |
|---|---|---|---|---|
| 2005/0034688 | A1* | 2/2005 | Lelkes | F01P 7/167 123/41.01 |
| 2005/0061263 | A1* | 3/2005 | Lee | F01P 7/167 123/41.1 |
| 2006/0196634 | A1* | 9/2006 | Sato | B60H 1/00885 165/41 |
| 2009/0308335 | A1* | 12/2009 | Dipaola | F01P 7/165 123/41.1 |
| 2013/0160723 | A1* | 6/2013 | Miyagawa | F01P 7/16 123/41.1 |
| 2013/0167784 | A1* | 7/2013 | Quix | F02M 26/33 123/41.1 |
| 2013/0213324 | A1* | 8/2013 | Saitoh | F01P 7/165 123/41.09 |
| 2016/0031291 | A1 | 2/2016 | Enomoto et al. | |

* cited by examiner

COOLING DEVICE AND COOLING METHOD FOR ENGINE

INCORPORATION BY REFERENCE

The disclosure of Japanese Patent Application No. 2015-182045 filed on Sep. 15, 2015 including the specification, drawings and abstract is incorporated herein by reference in its entirety.

BACKGROUND OF THE DISCLOSURE

1. Field of the Disclosure

The present disclosure relates to a cooling device and a cooling method for an engine.

2. Description of Related Art

Japanese Patent Application Publication No. 2014-201224 discloses an engine cooling device in which a coolant circuit that circulates a coolant through the inside of the engine is provided with a plurality of routes, including a radiator route passing through a radiator, and a multiway valve is provided at a branching position of these routes. The multiway valve has a plurality of discharge ports that discharge a coolant respectively to the plurality of routes, and switches the routes for the coolant to flow through by switching the open and closed states of the discharge ports. Japanese Patent Application Publication No. 2013-124656 describes an engine cooling device that performs coolant stop control of shutting off the outflow of a coolant from inside the engine by closing all the discharge ports of a multiway valve at engine cold start.

SUMMARY OF THE DISCLOSURE

Under extremely low temperature conditions, the coolant inside the coolant circuit freezes during an off-time of the ignition switch when the engine is stopped and the circulation of the coolant is stopped, which may result in a blockage in the circulation of the coolant immediately after engine start. In that case, the coolant inside the multiway valve may also freeze and make the multiway valve inoperable.

If the blocked state of the coolant circuit due to freezing continues after the pump starts to discharge the coolant, the pressure inside the coolant circuit on the upstream side from the blocked position rises gradually. Such pressure rise in the event of freezing needs to be factored into the design of the pressure resistance performance of each part of the coolant circuit.

In the engine cooling device that performs coolant stop control as described above, the multiway valve can assume a state in which all the discharge ports are closed. If the multiway valve becomes inoperable with all the discharge ports closed while the coolant circuit is frozen inside, the coolant warmed inside the engine no longer flows toward the downstream side from the multiway valve, which results in a delay in resolving the blockage in the coolant circuit due to freezing. Then, the pressure in the coolant circuit on the upstream side from the blocked position rises all the more significantly due to that delay. Therefore, if there is an undeniable possibility that all the discharge ports of the multiway valve may be closed when the coolant circuit is frozen inside, higher pressure resistance performance is required of each part of the coolant circuit. As a result, more expensive parts having higher pressure resistance performance are required, which may lead to an increase in manufacturing cost of the engine cooling device.

The present disclosure provides a cooling device and a cooling method for an engine that suppress pressure rise inside a coolant circuit due to freezing of a coolant.

A first aspect of the disclosure provides a cooling device for an engine, the cooling device includes a coolant circuit, a multiway valve and an electronic control unit. The cooling device includes a pump, a radiator, a plurality of routes. The plurality of routes is configured such that a coolant flows from the pump through the inside of the engine and returns to the pump. The plurality of routes is branched at a branching position on a downstream side from the inside of the engine. The plurality of routes is each connected to the pump. The plurality of routes includes a radiator route passing through the radiator. The multiway valve includes a plurality of discharge ports. The discharge ports are provided at the branching position of the plurality of routes in the coolant circuit. The discharge ports are configured to discharge the coolant respectively to the plurality of routes. The discharge ports include a radiator port. The radiator port is a discharge port that discharges the coolant to the radiator route. The multiway valve is configured to switch open and closed states of the discharge ports. The open and closed states of the discharge ports include a state in which all the discharge ports are closed. The electronic control unit is configured to control the multiway valve such that the radiator port closes and at least one of the discharge ports, other than the radiator port, opens when an ignition switch is turned off.

When the multiway valve is controlled so as to open at least one of the discharge ports and the ignition switch is turned off (hereinafter termed as IG turn-off operation), at least one of the discharge ports of the multiway valve is open when the ignition switch is turned on (hereinafter termed as IG turn-on operation). Accordingly, the possibility that all the discharge ports of the multiway valve may be closed when the coolant circuit is frozen inside can be eliminated. As a result, it is possible to estimate a shorter time to be taken to resolve a blockage in the coolant circuit due to freezing, and in turn to estimate a lower maximum pressure inside the coolant circuit when a blockage due to a frozen coolant occurs. Thus, the pressure resistance performance required of each part of the coolant circuit can be lowered.

However, if the radiator port is open when IG turn-on operation is performed, the coolant may flow into the radiator and refreeze by being cooled in the radiator. Moreover, engine warm-up is delayed as the coolant cooled in the radiator reflows into the engine. In this respect, the above engine cooling device is configured to open the discharge ports other than the radiator port when IG turn-off operation is performed. Accordingly, refreezing of the coolant and delayed warm-up as described above can be avoided. Thus, according to the above engine cooling device, it is possible to favorably suppress pressure rise inside the coolant circuit due to freezing of the coolant.

In the cooling device, the plurality of routes may include the radiator route, a heater route, and a third route. The heater route may pass through a heater core. The discharge ports may include the radiator port, a heater port, and a third discharge port. The heater port may be configured to discharge the coolant to the heater route. The third discharge port may be configured to discharge the coolant to the third route. The electronic control unit may be configured to control the multiway valve such that the radiator port closes and the heater port opens when the ignition switch is turned off and an outside air temperature is equal to or lower than a predetermined temperature. The electronic control unit may be configured to control the multiway valve such that the radiator port closes, the heater port closes and the third discharge port opens, when the ignition switch is turned off and the outside air temperature is higher than the predetermined temperature.

According to this configuration, the multiway valve is controlled so as to close the radiator port and open the heater port when IG turn-off operation is performed, if the outside air temperature is low and heating is likely to be used after engine restart. Thus, even when the coolant inside the coolant circuit freezes, it is possible to promptly unfreeze the inside of the heater route and promptly start heating.

By contrast, when the outside air temperature is high, heating is not likely to be used after engine restart. In a case where the heating is not used after engine is restarted, leaving the heater port open when IG turn-off operation causes the coolant to be supplied to the heater core after engine restart so that part of engine heat transferred to the coolant is wasted through heat dissipation at the heater core. For this reason, the multiway valve is controlled so as to close the heater port along with the radiator port and open the third discharge port at the time of IG turn-off operation if the outside air temperature is high, so that engine heat can be utilized more efficiently.

A second aspect of the disclosure provides a cooling method for an engine. The engine includes a cooling device. The cooling device includes a coolant circuit and a multiway valve. The coolant circuit includes a pump, a radiator, and a plurality of routes. The plurality of routes is configured to allow a coolant to flow from the pump through the inside of the engine and return to the pump. The plurality of routes is branched at a branching position on a downstream side from the inside of the engine. The plurality of routes is each connected to the pump. The plurality of routes includes a radiator route, the radiator route passing through the radiator. The multiway valve includes a plurality of discharge ports. The discharge ports are provided at the branching position of the plurality of routes in the coolant circuit. The discharge ports are configured to discharge the coolant respectively to the plurality of routes. The discharge ports include a radiator port. The radiator port is a discharge port that discharges the coolant to the radiator route. The multiway valve is configured to switch open and closed states of the discharge ports, the open and closed states of the discharge pods including a state in which all the discharge ports are closed. The cooling method includes: controlling the multiway valve such that the radiator port closes when an ignition switch is turned off; and controlling the multiway valve such that at least one of the discharge ports, other than the radiator port, opens when an ignition switch is turned off.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

In the following, one embodiment of an engine cooling device will be described in detail with reference to FIG. 1 to FIG. 8. First, the configuration of a coolant circuit through which a coolant for cooling an engine flows in the engine cooling device of this embodiment will be described with reference to FIG. 1.

Figure 1:
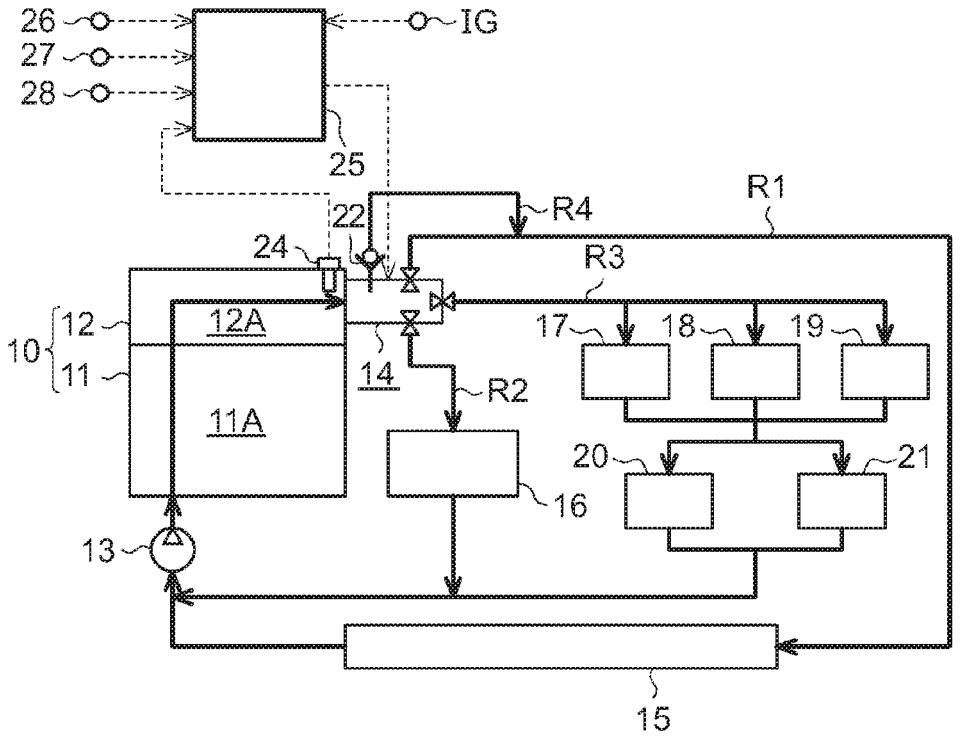
FIG. 1 is a view schematically showing the entire structure of an engine cooling device in one embodiment.

As shown in FIG. 1, water jackets 11A, 12A that constitute a part of the coolant circuit are respectively provided inside a cylinder block 11 and a cylinder head 12 of an engine 10. A coolant pump 13 that circulates the coolant through the coolant circuit is provided in the coolant circuit on the upstream side from the water jackets 11A, 12A. The coolant discharged by the coolant pump 13 is introduced into the water jackets 11A, 12A. The water jacket 12A of the cylinder head 12 is provided with an outlet coolant temperature sensor 24 that detects the temperature of the coolant immediately before flowing out of the water jacket 12A (outlet coolant temperature TO).

A multiway valve 14 is mounted in the cylinder head 12 at a part of the water jacket 12A where a coolant outlet is provided, so that the coolant having passed through the water jackets 11A, 12A flows into the multiway valve 14. The coolant circuit is branched at the multiway valve 14 into three routes: a radiator route R1, a heater route R2, and a device route R3 as the other, third route. The radiator route R1 is a route through which the coolant is supplied to a radiator 15 that cools the coolant through heat exchange with outside air. The heater route R2 is a route through which the coolant is supplied to a heater core 16 being a heat exchanger that heats air, to be sent to the vehicle interior, with the heat of the coolant during heating of the vehicle interior. The device route R3 is a route through which the coolant is supplied to various devices to which the heat of the engine 10 is transferred by the coolant acting as a delivery medium. The flow passage sectional area of the radiator route R1 is larger than the flow passage sectional areas of the heater route R2 and the device route R3 to allow a larger amount of coolant to flow through the radiator route R1.

The radiator route R1 supplies the coolant to the radiator 15, and then the part of the radiator route R1 on the downstream side from the radiator 15 is connected to the coolant pump 13. The device route R3 is first branched into three routes, and supplies the coolant to a throttle body 17, an exhaust gas recirculation (EGR) valve 18, and an EGR cooler 19 at their respective branch destinations. After the three routes are temporarily merged together on the downstream side from the throttle body 17, the EGR valve 18, and the EGR cooler 19, the device route R3 is branched into two routes, and supplies the coolant to an oil cooler 20 and an automatic transmission fluid (ATF) warmer 21 at their respective branch destinations. The two routes are merged together on the downstream side from the oil cooler 20 and the ATF warmer 21, and the part of the device route R3 on the downstream side from that merging position is merged with the part of the radiator route R1 on the downstream side from the radiator 15. The part of the device route R3 on the downstream side from that merging position is integrated with the radiator route R1 and connected to the coolant pump 13. The heater route R2 supplies the coolant to the heater core 16, and then the part of the heater route R2 on the downstream side from the heater core 16 is merged with the part of the device route R3 on the downstream side from the oil cooler 20 and the ATF warmer 21. The part of the heater route R2 on the downstream side from that merging position is integrated with the device route R3, and the part of the heater route R2 on the downstream sick from the merging position of the device route R3 and the radiator route R1 is further integrated with the radiator route R1 and connected to the coolant pump 13.

Thus, the coolant circuit is configured to allow the coolant to flow from the coolant pump 13 through the inside (water jackets 11A, 12A) of the engine 10 and return to the coolant pump 13. The coolant circuit has the plurality of routes, namely three routes of the radiator route R1, the heater route R2, and the device route R3, that are branched on the downstream side from the inside of the engine 10 and each connected to the coolant pump 13. The multi way valve 14 is provided at the branching position of the three routes R1 to R3 in the coolant circuit.

The multiway valve 14 is provided with a relief valve 22 that opens when the internal pressure of the multiway valve 14 rises excessively and thereby releases the pressure of the coolant inside the valve. A relief route R4 is connected to the relief valve 22, and the downstream-side part of the relief route R4 is merged with the part of the radiator route R1 on the upstream side from the radiator 15.

The multiway valve 14 is controlled by an electronic control unit 25 that is responsible for the engine control. The electronic control unit 25 includes a central processor that performs various calculations related to the engine control, a read-only memory in which programs and data for the control are stored in advance, and a readable-writable memory in which calculation results of the central processor, detection results of sensors, etc. are temporarily stored. Detection signals of sensors provided at various parts of the vehicle, including a crank angle sensor 26, an air flowmeter 27, and an outside air temperature sensor 28 in addition to the outlet coolant temperature sensor 24, are input into the electronic control unit 25. The crank angle sensor 26 detects the rotation phase of a crankshaft that is the output shaft of the engine 10 (crank angle). The electronic control unit 25 calculates the rotation speed of the engine 10 (engine speed) from the detection result of the crank angle. The air flowmeter 27 detects the flow rate of air taken into the engine 10 (intake air flow rate), and the outside air temperature sensor 28 detects the temperature of air outside the vehicle (outside air temperature). An IG signal that indicates whether an ignition switch IG is on or off is also input into the electronic control unit 25.

Next, the configuration of the multiway valve 14 provided in the coolant circuit of the engine cooling device in this embodiment will be described with reference to FIG. 2 to FIG. 5. In the following description, the side indicated by the arrow U and the side indicated by the arrow D in FIG. 2 to FIG. 5 will be respectively referred to as the upper side and the lower side of the multiway valve 14.

Figure 2:
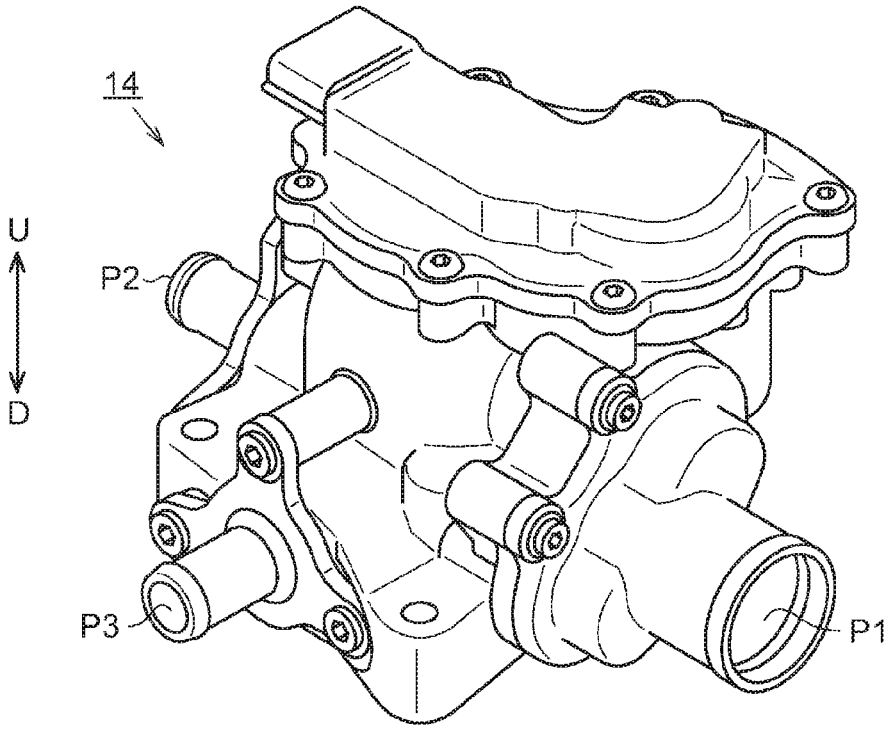
FIG. 2 is a perspective view of a multiway valve provided in the engine cooling device.

As shown in FIG. 2, the multiway valve 14 includes three discharge ports serving as coolant discharge ports. The three discharge ports are a radiator port P1, a heater port P2, and a device port P3. When the multiway valve 14 is incorporated into the engine 10, the radiator port P1 is connected to the radiator route R1 and constitutes a part of the radiator route R1. The heater port P2 is connected to the heater route R2 and constitutes a part of the heater route R2. The device port P3 is connected to the device route R3 and constitutes a part of the device route R3.

Figure 3:
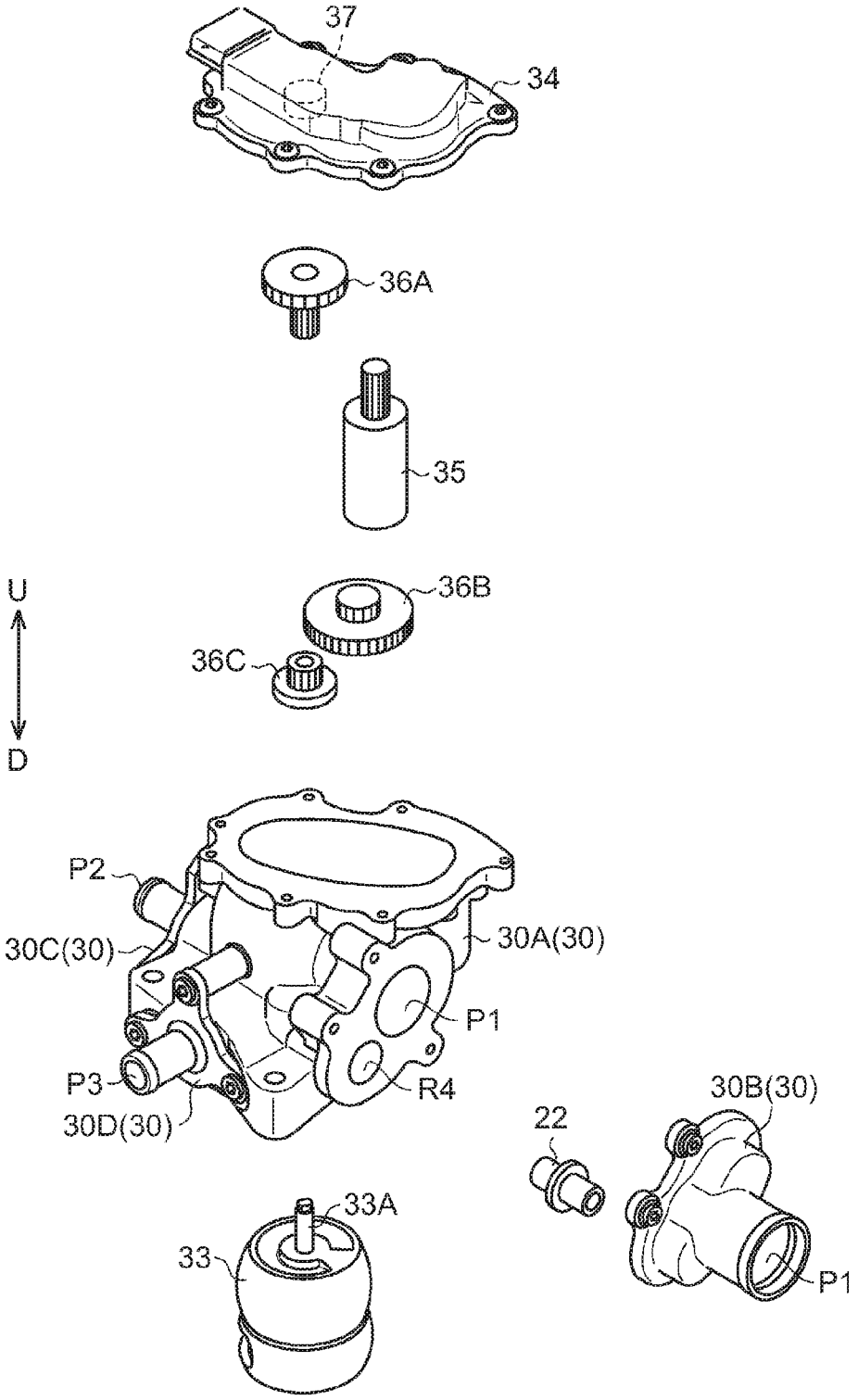
FIG. 3 is an exploded perspective view of the multiway valve.

As shown in FIG. 3, the multiway valve 14 includes, as the components thereof, a housing 30, a valve body 33, a cover 34, a motor 35, and a reduction gear mechanism composed of three gears 36A, 36B, 36C. The housing 30 constituting the skeleton of the multiway valve 14 is provided with the three discharge ports P1 to P3. The housing 30 is divided into a main body 30A, and connector portions 30B to 30D to which the routes R1 to R3 are respectively connected. In FIG. 3, the housing 30 is shown with the connector portion 30B of the radiator route R1 being separated from the main body 30A.

The valve body 33 that rotates and varies the opening areas of the discharge ports P1 to P3 accordingly is housed in a lower part of the main body 30A of the housing 30. The motor 35 and the reduction gear mechanism are housed in an upper part of the main body 30A of the housing 30. The motor 35 is housed in the housing 30 while being coupled to a valve stem 33A, which is the rotating shaft of the valve body 33, through the gears 36A to 36C composing the reduction gear mechanism. Thus, the rotation of the motor 35 is reduced in speed before being transmitted to the valve body 33.

The cover 34 is mounted on the housing 30 so as to cover the upper side of the part where the motor 35 and the reduction gear mechanism are housed. A valve phase sensor 37 that detects the rotation phase of the valve body 33 relative to the housing 30 (hereinafter termed as a valve phase) is mounted inside the cover 34. Detection signals of the valve phase sensor 37 are input into the electronic control unit 25. The relief valve 22 is housed inside the housing 30.

Figure 4:
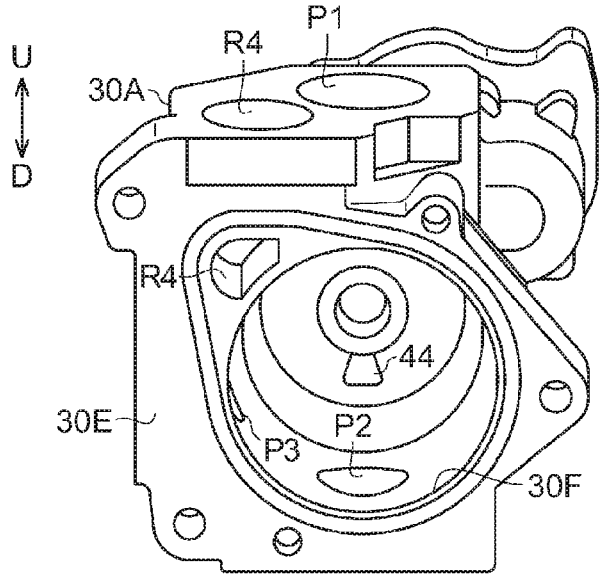
FIG. 4 is a perspective view of a main body of a housing that is a component of multiway valve.

FIG. 4 shows the stricture of the main body 30A of the housing 30 in a perspective view from below. The lower surface of the main body 30A is a mounting surface 30E on which the multiway valve 14 is mounted on the cylinder head 12, and the multiway valve 14 is incorporated into the engine 10 with the mounting surface 30E in contact with an outer wall of the cylinder head 12. The space inside the main body 30A where the valve body 33 is housed is open to the mounting surface and the opening serves as an inflow port 30F through which the coolant flows in from the water jacket 12A of the cylinder head 12. The three discharge ports P1 to P3 are each open on the inner side of the housing 30 to the space where the valve body 33 is housed.

The relief route R4 is provided in the main body 30A of the housing 30 so as to provide communication between the inflow port 30F and the radiator port P1 without the valve body 33 therebetween. The relief valve 22 is installed in the relief route R4.

Figure 5A:
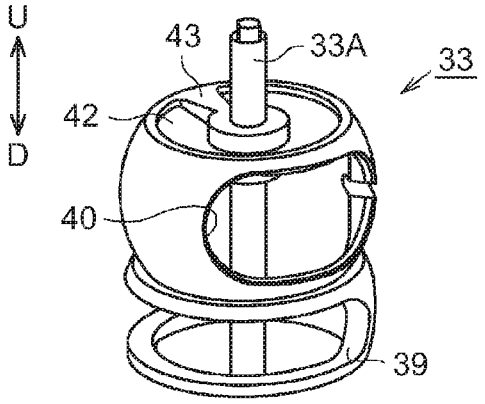
FIG. 5A is a perspective view of a valve body that is a component of the multiway valve.
Figure 5B:
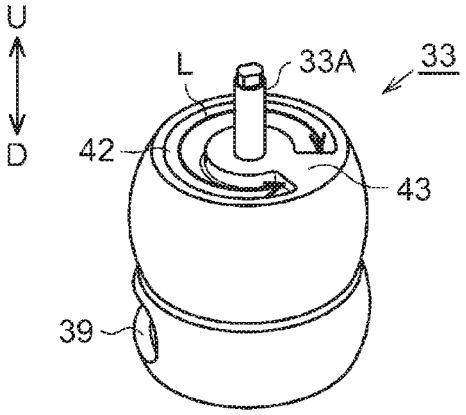
FIG. 5B is a perspective view of the valve body as seen from a direction different from that of FIG. 5A.

As shown in FIG. 5A, the valve body 33 has the shape of two barrel-shaped objects laid on top of each other. The valve body 33 is provided with the valve stem 33A so as to protrude upward from the center of the upper surface of the valve body 33. The valve body 33 has a hollow structure with an opening provided in the lower surface that communicates with the inflow port 30F when the valve body 33 is housed in the housing 30. On the side peripheries of the two barrel parts, the valve body 33 is provided with two holes 39, 40 through which the coolant can flow.

In the state where the valve body 33 is housed in the housing 30, the hole 39 provided in a lower part of the valve body 33 communicates with at least one of the heater port P2 and the device port P3 while the valve phase is within a certain range. The hole 40 provided in an upper part of the valve body 33 communicates with the radiator port P1 while the valve phase is within another range. When the valve body 33 is located at a position where the discharge ports P1 to P3 do not at all overlap the corresponding hole 39 or hole 40, the discharge ports P1 to P3 are closed and thereby shut off the discharge of the coolant to the routes R1 to R3 connected thereto. When the valve body 33 is located at a position where the discharge ports P1 to P3 partially or entirely overlap the hole 39 or the hole 40, the discharge ports P1 to P3 are opened and thereby allow the discharge of the coolant to the routes R1 to R3 connected thereto.

A groove 42 is formed in the upper surface of the valve body 33 so as to extend in an arc shape surrounding a root portion of the valve stem 33A while leaving a part of the upper surface as a stopper 43. As shown in FIG. 4, a stopper 44 that is housed inside the groove 42 when the valve body 33 is housed is formed in a deep part of the space where the valve body 33 is housed in the housing 30. As the stoppers 43, 44 come into contact with each other, the turning range of the valve body 33 inside the housing 30 is limited. That is, the valve body 33 is allowed to turn inside the housing 30 to such an extent that the movement of the stopper 44 inside the groove 42 is within the range indicated by the arrow L in FIG. 5B.

Figure 6:
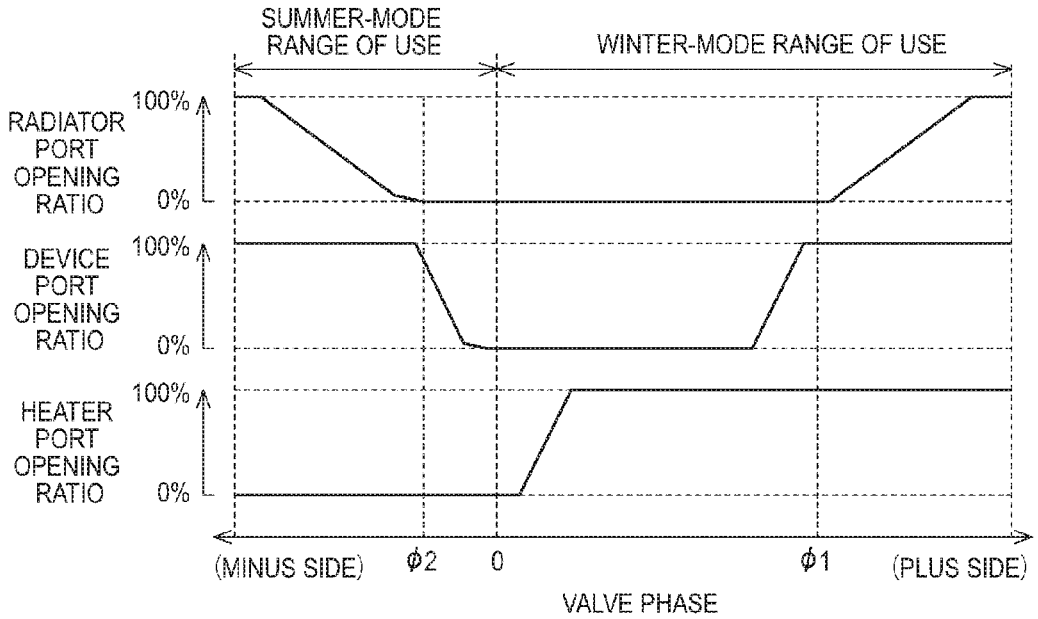
FIG. 6 is a graph showing a relation between the valve phase of the valve body of the multiway valve and the opening ratios of discharge ports.

FIG. 6 shows a relation between the valve phase of the multiway valve 14 and the opening ratios of the discharge ports P1 to P3. With a position at which all the discharge ports P1 to P3 are closed taken as the position of the valve phase 0°, the valve phase represents the rotation angle of the valve body 33 from that position in the clockwise direction (plus direction) and the counterclockwise direction (minus direction) as seen from above. The opening ratios represent the ratios of the opening areas of the discharge ports P1 to P3, with the opening areas of the discharge ports fully opened taken as 100%.

As shown in FIG. 6, the opening ratios of the discharge ports P1 to P3 are set so as to vary according to the valve phase of the valve body 33. The range of the valve phase on the plus side from the position of the valve phase 0° is regarded as a range of valve phase (winter-mode range of use) that is used when the outside air temperature is low and heating of the vehicle interior is likely to be used (in winter mode). By contrast, the range of the valve phase on the minus side from the position of the valve phase 0° is regarded as a range of valve phase (summer-mode range of use) that is used when outside air temperature is high and heating of the vehicle interior is not likely to be used (in summer mode).

When the valve body 33 is turned in the plus direction from the position of the valve phase 0°, the heater port P2 first starts to open, and the opening ratio of the heater port P2 increases gradually as the valve phase increases in the plus direction. When the heater port P2 is fully opened, i.e., the opening ratio thereof reaches 100%, the device port P3 next starts to open, and the opening ratio of the device port 93 increases gradually as the valve phase increases in the plus direction. When the device port P3 is fully opened, i.e., the opening ratio thereof reaches 100%, the radiator port P1 starts to open, and the opening ratio of the radiator port P1 increases gradually as the valve phase increases in the plus direction. Then, the opening ratio of the radiator port P1 reaches 100% before the valve body 33 reaches a position at which further turning of the valve body 33 in the plus direction is restricted by the stoppers 43, 44 coming into contact with each other.

Conversely, when the valve body 33 is turned in the minus direction from the position of the valve phase 0°, the device port P3 first starts to open, and the opening ratio of the device port P3 increases gradually as the valve phase increases in the minus direction. The radiator port P1 starts to open shortly before the valve body 33 reaches a position at which the device port P3 is fully opened, i.e., the opening ratio thereof reaches 100%, and the opening ratio of the radiator port P1 increases gradually as the valve phase increases in the minus direction. Then, the opening ratio of the radiator port P1 reaches 100% before the valve body 33 reaches a position at which further turning of the valve body 33 in the minus direction is restricted by the stoppers 43, 44 coming into contact with each other. In the summer-mode range of use that is on the minus side from the position of the valve phase 0°, the heater port P2 is normally fully closed.

Figure 7:
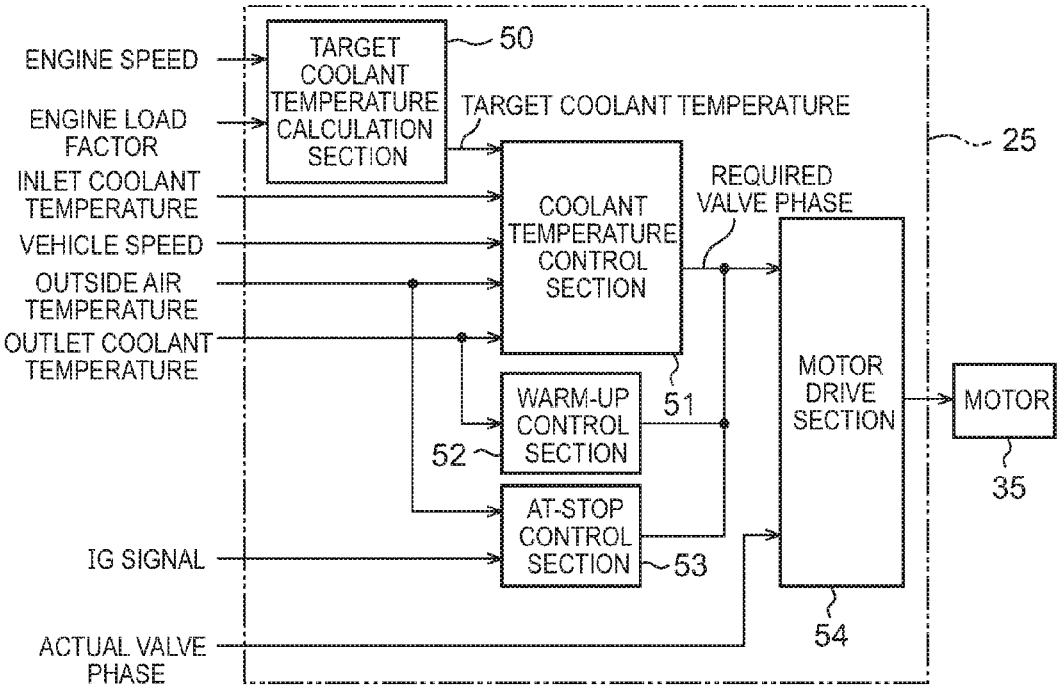
FIG. 7 is a control block diagram of constituents involved in the control of the multiway valve in one embodiment of the engine cooling device.

Next, the outline of the control of the multiway valve 14 will be described with reference to FIG. 7. FIG. 7 shows a control block diagram of the electronic control unit 25 involved in the control of the multiway valve 14. The electronic control unit 25 includes, as the constituents involved in the control of the multiway valve 14, a target coolant temperature calculation section 50, a coolant temperature control section 51, a warm-up control section 52, an at-stop control section 53, and a motor drive section 54 that drives the motor 35 of the multiway valve 14. In practice, however, the functions of the target coolant temperature calculation section 50, the coolant temperature control section 51, the warm-up control section 52, the at-stop control section 53, and the motor drive section 54 are realized through processes performed by the central processor of the electronic control unit 25.

The target coolant temperature calculation section 50 calculates a target coolant temperature that is a target value of the outlet coolant temperature upon completion of warm-up of the engine 10, and outputs the target coolant temperature to the coolant temperature control section 51. An optimal outlet coolant temperature to secure the fuel economy performance of the engine 10 is set as the value of the target coolant temperature on the basis of the engine speed, the engine load factor, etc. The engine load factor represents the ratio of cylinder air inflow rate when the cylinder air inflow rate with the throttle of the engine 10 fully opened at the current engine speed is taken as 100%, and the value of the engine load factor is calculated from detection results of the engine speed the intake air flow rate, etc.

The coolant temperature control section 51 calculates, as a required valve phase, the valve phase of the multiway valve 14 that is required to bring the outlet coolant temperature to the target coolant temperature calculated by the target coolant temperature calculation section 50, and outputs the required valve phase to the motor drive section 54. Specifically, the coolant temperature control section 51 makes feedback adjustment to the required valve phase according to a deviation between the target coolant temperature and the outlet coolant temperature. That is, when the outlet coolant temperature is higher than the target coolant temperature, to increase the flow rate of the coolant supplied to the radiator 15, the coolant temperature control section 51 adjusts the required valve phase toward a side on which the opening ratio of the radiator port P1 becomes larger. When the outlet coolant temperature is lower than the target coolant temperature, to reduce the flow rate of the coolant supplied to the radiator 15, the coolant temperature control section 51 adjusts the required valve phase toward a side on which the opening ratio of the radiator port P1 becomes smaller.

The coolant temperature control section 51 sets the required valve phase such that the range of use of the valve phase of the multiway valve 14 is switched according to the outside air temperature. That is, when an outside air temperature THA is equal to or lower than a predetermined temperature α and heating of the vehicle interior is likely to be used, the coolant temperature control section 51 sets the required valve phase to a valve phase within the winter-mode range of use, and when the outside air temperature is above the predetermined temperature α and heating of the vehicle interior is not likely to be used, the coolant temperature control section 51 sets the required valve phase to a valve phase within the summer-mode range of use. However, when warm-up of the engine 10 is yet to be completed or the engine 10 is in the process of stopping, the coolant temperature control section 51 outputs an invalid value as the required valve phase to the motor drive section 54.

The warm-up control section 52 calculates a required valve phase of the multiway valve 14 before completion of warm-up of the engine 10 (at-warm-up required valve phase), and outputs the required valve phase to the motor drive section 54. Specifically, the warm-up control section 52 calculates, as the required valve phase, the valve phase of the multiway valve 14 that is required to promote the warm-up of the engine 10 and secure the heating performance according to the outlet coolant temperature and the presence or absence of a heating requirement. In this embodiment, when the outlet coolant temperature during warm-up of the engine 10 is equal to or lower than a specified coolant stop completion temperature, coolant slop control of closing all the discharge ports P1 to P3 of the multiway valve 14 and stopping the circulation of the coolant through the coolant circuit is performed. In this case, the warm-up control section 52 sets, as the required valve phase, the position of the valve phase 0° at which all the discharge ports P1 to P3 are closed. When the outlet coolant temperature is above the coolant stop completion temperature and equal to or lower than a warm-up completion temperature at which warm-up of the engine 10 is determined to be completed, the warm-up control section 52 sets the required valve phase such that the opening ratio of the device port P3 approaches 100% as the outlet coolant temperature approaches the warm-up completion temperature.

The warm-up control section 52 also sets the required valve phase such that the range of use of the valve phase of the multiway valve 14 is switched according to the outside temperature. That is, when the outside air temperature is equal to or lower than the predetermined temperature α and heating of the vehicle interior is likely to be used, the warm-up control section 52 sets the required valve phase to a valve phase within the winter-mode range of use, and when the outside air temperature is above the predetermined temperature α and heating of the vehicle interior is not likely to be used, the warm-up control section 52 sets the required valve phase to a valve phase within the summer-mode range of use. However, when warm-up of the engine 10 has been completed, the warm-up control section 52 outputs an invalid value as the required valve phase to the motor drive section 54.

The at-stop control section 53 calculates a required valve phase of the multiway valve 14 under at-stop control that is executed when the ignition switch IG is turned off (at-stop required valve phase), and outputs the required valve phase to the motor drive section 54. However, at times other than during at-stop control, the at-stop control section 53 outputs an invalid value as the required valve to the motor drive section 54.

The motor drive section 54 selects a valid value from the required valve phases input from the coolant temperature control section 51, the warm-up control section 52, and the at-stop control section 53, and drives the motor 35 such that the value of the valve phase of the multiway valve 14 detected by the valve phase sensor 37 (actual valve phase) becomes that value. As described above, the conditions under which the coolant temperature control section 51, the warm-up control section 52, and the at-stop control section 53 output a valid required valve phase do not overlap one another, so that there is only one valid required valve phase input into the motor drive section 54 at one time. Accordingly, when the ignition switch IG is turned off, only the at-stop control section 53 outputs a valid required valve phase to the motor drive section 54 to make the motor drive section 54 drive the motor 35 of the multiway valve 14 such that the valve phase becomes the required valve phase (at-stop required valve phase).

Next, the details of at-stop control performed by the at-stop control section 53 will be described with reference to FIG. 8.

Figure 8:
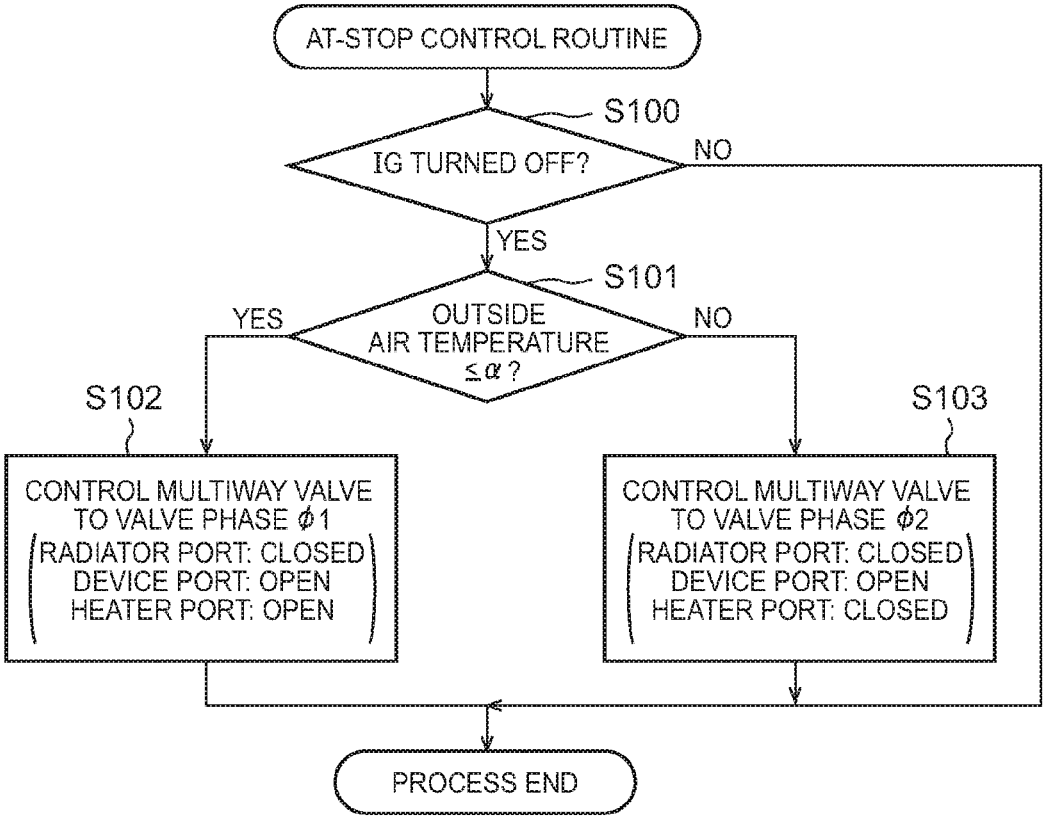
FIG. 8 is a flowchart of an at-stop control routine executed by an at-stop control section in the embodiment.

FIG. 8 is a flowchart showing the procedure of an at-stop control routine executed by the at-stop control section 53. The process of the at-stop control routine is repeatedly executed in predetermined control cycles during a period from when the ignition switch IG is turned on and power supply to the electronic control unit 25 is started until when the ignition switch IG is turned off and then an at-stop process is completed and power supply to the electronic control unit 25 is stopped.

When the process of the routine is started, first, it is determined in step S100 whether or not the ignition switch IG has been turned off. Here, if the ignition switch IG has been turned off (YES), the process continues to step S101, and if the ignition switch IG has not been turned off (NO), the current process is directly ended.

When the process continues to step S101, it is determined in step S101 whether or not the outside air temperature THA is equal to or lower than the predetermined temperature α. The determination in this step is made to confirm whether or not it is likely that heating is used after engine restart. That is, if the outside air temperature THA is so low when the ignition switch IG is turned off that heating is likely to be used, it is conceivable that the outside air temperature THA will be equally low at the next engine restart and heating will be likely to be used thereafter. Thus, in this embodiment, it is determined that heating is likely to be used after engine restart on the basis of the condition that the outside air temperature THA is equal to or lower than the predetermined temperature α.

If it is determined in step S101 that the outside air temperature THA is equal to or lower than the predetermined temperature α, i.e., there is a heating requirement (YES), the process continues to step S102, in step S102, the multiway valve 14 is controlled such that the valve phase of the valve body 33 reaches the position φ1 shown in FIG. 6, and then the process of the routine is ended. The valve phase φ1 is an at-stop required valve phase in winter mode, and is set to a valve phase at which the radiator port P1 is closed and the heater port P2 and the device port P3 are fully opened. In this case, the at-stop control section 53 outputs such valve phase φ1 as the required valve phase to the motor drive section 54 to make the motor drive section 54 drive the motor 35 of the multiway valve 14 such that the valve phase becomes the valve phase φ1.

If it is determined in step S101 that the outside air temperature THA is higher than the predetermined temperature α, i.e., there is no heating requirement (NO), the process continues to step S103. In step S103, the multiway valve 14 is controlled such that the valve phase of the valve body 33 reaches the position φ2 shown in FIG. 6, and then the process of the routine is ended. The valve phase φ2 is an at-stop required valve phase in summer mode, and is set to a valve phase at which the radiator port P1 and the heater port P2 are closed and the device port P3 is almost fully opened. In this case, the at-stop control section 53 outputs such valve phase φ2 as the required valve phase to the motor drive section 54 to make the motor drive section 54 drive the motor 35 of the multiway valve 14 such that the valve phase becomes the valve phase φ2.

Next, the workings of the above-described embodiment will be described. Under extremely low temperature conditions, the coolant inside the coolant circuit freezes while the engine 10 is stopped, which may result in a blockage in the circulation of the coolant through the coolant circuit. In that case, the coolant inside the multiway valve 14 may also freeze and make the multiway valve 14 inoperable.

In this situation, if the ignition switch IG is turned on and the engine 10 is started, unfreezing of the coolant inside the coolant circuit is promoted mainly through the transfer of the heat of the engine 10 by the coolant acting as a delivery medium. However, if all the discharge ports P1 to P3 of the multiway valve 14 are closed at this point, the transfer of heat by the coolant acting as a delivery medium is shut off at the multiway valve 14, so that the heat of the engine 10 is hardly transferred to the part of the coolant circuit on the downstream side from the multiway valve 14. As a result, the resolution of the blockage in the coolant circuit due to freezing is delayed.

When the engine 10 is started, the coolant pump 13 starts to discharge the coolant. Therefore, if the blocked state of the coolant circuit due to freezing continues after start of the engine 10, the pressure of the coolant circuit on the upstream side from the blocked part increases gradually. This pressure rise becomes larger as more time is taken to resolve the blockage. Thus, if there is an undeniable possibility that all the discharge ports P1 to P3 of the multiway valve 14 may be closed at the time of IG turn-on operation, such pressure rise inside the coolant circuit in the event of freezing has to be estimated to be a higher pressure. As a result, it is necessary to accordingly enhance the pressure resistance performance required of each part of the coolant circuit, and more expensive parts having higher pressure resistance performance are required, which leads to an increase in the manufacturing cost.

In this respect, in the engine cooling device of this embodiment, the multiway valve 14 is controlled so as to close the radiator port P1 and open the device port P3 (in summer mode) or open both the heater port P2 and the device port P3 (in winter mode) at the time of IG turn-off operation. Thus, it is guaranteed that at least one of the three discharge ports P1 to P3 of the multiway valve 14 is open at the time of next IG turn-on operation. That is, in the engine cooling device of this embodiment, it is possible to eliminate the possibility that all the discharge ports P1 to P3 of the multi way valve 14 may be closed in the event of freezing inside the coolant circuit. As a result, it is possible to estimate a shorter time to be taken to resolve a blockage in the coolant circuit due to freezing, and in turn to estimate a lower maximum pressure inside the coolant circuit when a blockage due to a frozen coolant occurs. Accordingly, less expensive parts having lower pressure resistance performance can be adopted, so that the manufacturing cost of the engine cooling device can be kept down.

If the radiator port P1 is open in the event of freezing of the coolant circuit, the coolant unfrozen by the heat of the engine 10 may flow into the radiator 15 and refreeze by being cooled in the radiator 15. Moreover, warm-up of the engine 10 is delayed as the coolant cooled in the radiator 15 reflows into the engine 10. In this respect, in the engine cooling device of this embodiment, the discharge ports (P2, P3) other than the radiator port P1 are opened at the time of IG turn-off operation, so that such refreezing of the coolant and delayed warm-up can be avoided.

If the outside air temperature is so high that no heating is required at the time of IG turn-off operation, it is in most cases conceivable that heating will not be required after the next restart of the engine either. Moreover, there is an extremely low possibility in such a case that the coolant circuit will be frozen inside at the next engine restart.

If heating is not used after restart of the engine 10, leaving the heater port P2 open at the time of IG turn-off operation causes the coolant to be supplied to the heater core 16 after restart of the engine 10 while the multiway valve 14 is being operated until the valve phase enters the summer-mode range of use. If the coolant is supplied to the heater core 16 despite heating not intended to be used, the temperature of the coolant decreases due to heat dissipation at the heater core 16, causing a delay in warm-up of the engine 10. Moreover, the amount of heat supplied to the various devices disposed on the device route R3 decreases by the amount of heat dissipation at the heater core 16.

In this respect, in this embodiment, if the outside air temperature is high and heating is not likely to be used after restart of the engine 10, the valve body 33 is positioned at the time of IG turn-off operation to a valve phase within the summer-mode range of use at which the heater port P2 along with the radiator port P1 is closed and only the device port P3 is opened. Accordingly, it is unlikely that the coolant is unnecessarily supplied to the heater core 16 after restart of the engine 10 despite heating not intended to be used.

The engine cooling device of the embodiment having been described above can offer the following advantages. (1) In this embodiment, at least one of the discharge ports (P2, P3) other than the radiator port P1 is opened at the time of IG turn-off operation. Thus, it is possible to avoid a delay in resolving a blockage in the coolant circuit due to freezing when the coolant circuit is frozen inside at the time of next IG turn-on operation, and in turn to suppress pressure rise inside the coolant circuit due to that delay.

(2) The radiator port P1 is closed at the time of IG tarn-off operation. Thus, it is possible to avoid the situation where the coolant refreezes by being cooled in the radiator 15 or the cooled coolant flows into the engine 10 and causes a delay in warm-up of the engine 10.

(3) Pressure rise inside the coolant circuit due to a blockage in the coolant circulation in the event of freezing can be suppressed. Thus, it is possible to adopt less expensive parts having lower pressure resistance performance as the components of the coolant circuit, and in turn to reduce the manufacturing cost of the engine cooling device.

(4) If the outside air temperature is high and heating is not likely to be used after engine restart, the heater port P2 along with the radiator port P1 is closed and only the device port P3 is opened at the time of IG turn-off operation. Thus, it is possible to enhance the heat utilization efficiency of the engine 10 by suppressing unnecessary supply of the coolant to the heater core 16 after restart of the engine 10 when heating is not used.

(5) If the outside air temperature is low and heating is likely to be used at engine restart, the heater port P2 in addition to the device port P3 is opened at the time of IG turn-off operation. Thus, it is possible to promote the resolution of a blockage in the heater route R2 due to freezing, and in turn to promptly start heating.

The above embodiment can also be implemented with the following modifications made thereto. In the above embodiment, the heater port P2 and the device port P3 are fully opened or almost fully opened when these ports are opened at the time of IG turn-off operation. However, even when the discharge ports are opened to a smaller extent, the resolution of a blockage in the coolant circuit in the event of freezing can be promoted as long as the coolant can flow through the discharge ports. Accordingly, the position of the valve phase to which the multiway valve 14 is driven under at-stop control may be other than the positions φ1 and φ2 shown in FIG. 6, as long as the radiator port P1 is closed and at least one of the other discharge ports is open at that position.

In the above embodiment, if the outside air temperature is equal to or lower than the predetermined temperature α, the two discharge ports, the heater port P2 and the device port P3, are opened at the time of IG turn-off operation. In this case, however, only the heater port P2 may be independently opened. Then, the coolant can flow intensively only through the heater route R2 after IG turn-on operation, so that it is possible to even more promptly resolve a blockage in the heater route R2 due to freezing and more promptly start heating.

In the above embodiment, the discharge port to be closed at the time of IG turn-off operation is changed according to the outside air temperature. However, the discharge port to be closed at the time of IG turn-off operation may be fixed. In either case, it is possible to promote the resolution of a blockage in the coolant circuit due to freezing if the radiator port P1 is closed and at least one of the other discharge ports P2, P3 is opened at the time of IG turn-off operation.

In the above embodiment, the coolant circuit having the three routes, the radiator route R1, the heater route R2, and the device route R3, as the routes branched by the multiway valve 14 has been illustrated. However, similar at-stop control can be adopted in an engine cooling device that includes a coolant circuit having a different number of the routes branched at the multiway valve 14. For example, in an engine cooling device including a coolant circuit that is branched at the multiway valve 14 into two routes including the radiator route R1, it is possible to favorably suppress pressure rise inside the coolant circuit due to freezing of the coolant by controlling the multiway valve 14 so as to close the radiator port P1 and open the discharge port connected to the other route at the time of IG turn-off operation. In an engine cooling device including a coolant circuit that is branched into four or more routes at the multiway valve 14, too, it is possible to favorably suppress pressure rise inside the coolant circuit due to freezing of the coolant by controlling the multiway valve 14 so as to close the radiator port P1 and open at least one of the other discharge ports at the time of IG turn-off operation. If the heater route R2 passing through the heater core 16 is included in the routes branched at the multiway valve 14 in such an engine cooling device, it is desirable that the discharge port to be opened at the time of IG turn-off operation is changed according to the outside air temperature. That is, it is possible to further enhance the heat utilization efficiency by including the heater port P2 in the discharge ports to be opened at the time of IG turn-off operation if the outside air temperature is equal to or lower than the predetermined temperature α, and not including the heater port P2 in the discharge ports to be opened at the time of IG turn-off operation if the outside air temperature is higher than the predetermined temperature α.

What is claimed is:

1. A cooling device for an engine, the cooling device comprising:

a coolant circuit including a pump, a radiator, and a plurality of routes, the plurality of routes being configured such that a coolant flows from the pump through the inside of the engine and returns to the pump, the plurality of routes being branched at a branching position on a downstream side from the inside of the engine, the plurality of routes being each connected to the pump, the plurality of routes including a radiator route passing through the radiator, a heater route passing through a heater core, and a device route passing through a device, a multiway valve including a plurality of discharge ports, the discharge ports being provided at the branching position of the plurality of routes in the coolant circuit, the discharge ports being configured to discharge the coolant respectively to the plurality of routes, the discharge ports including a radiator port being a discharge port that discharges the coolant to the radiator route, a heater port being a discharge port that discharges the coolant to the heater route, and a device port being a discharge port that discharges the coolant to the device route, the multiway valve being configured to switch open and closed states of the discharge ports, the open and closed states of the discharge ports including a state in which all the discharge ports are closed;

an electronic control unit configured to control the multiway valve; and an outside air temperature sensor which measures an outside air temperature, wherein the electronic control unit is configured to control the multiway valve such that the radiator port closes and the heater port opens when the outside air temperature is equal to or lower than a predetermined temperature and an ignition switch is turned off so that the engine is stopped, and wherein the electronic control unit is configured to control the multiway valve such that the radiator port closes, the heater port closes and the device port opens, when the outside air temperature is higher than the predetermined temperature and the ignition switch is turned off so that the engine is stopped.

2. The cooling device according to claim 1, wherein the device route is branched into three routes supplying the coolant to a throttle body, an exhaust gas recirculation (EGR) valve, and an EGR cooler, merged together on a downstream side of the throttle body, the EGR valve, and the EGR cooler, and is branched into two routes supplying the coolant to an oil cooler and an automatic transmission fluid (ATF) warmer.

3. The cooling device according to claim 2, wherein a part of the heater route downstream of the heater core is merged with a part of the device route downstream of the oil cooler and the ATF warmer.

4. A cooling method for an engine, the engine including a cooling device, the cooling device including a coolant circuit and a multiway valve, the coolant circuit including a pump, a radiator, and a plurality of routes, the plurality of routes being configured to allow a coolant to flow from the pump through the inside of the engine and return to the pump, the plurality of routes being branched at a branching position on a downstream side from the inside of the engine, the plurality of routes being each connected to the pump, the plurality of routes including a radiator route passing through the radiator, a heater route passing through a heater core, and a device route passing through a device, and the multiway valve including a plurality of discharge ports, the discharge ports being provided at the branching position of the plurality of routes in the coolant circuit, the discharge ports being configured to discharge the coolant respectively to the plurality of routes, the discharge ports including a radiator port being a discharge port that discharges the coolant to the radiator route, the multiway valve being configured to switch open and closed states of the discharge ports, the open and closed states of the discharge ports including a state in which all the discharge ports are closed, a heater port being a discharge port that discharges the coolant to the heater route, and a device port being a discharge port that discharges the coolant to the device route, the cooling method comprising:

measuring an outside air temperature using an outside air temperature sensor;

controlling the multiway valve such that the radiator port closes and the heater port opens when the outside air temperature is equal to or lower than a predetermined temperature and an ignition switch is turned off so that the engine is stopped; and controlling the multiway valve such that the radiator port closes, the heater port closes, and the device port opens, when the outside air temperature is higher than the predetermined temperature and the ignition switch is turned off so that the engine is stopped.

5. The cooling method according to claim 4, wherein the device route is branched into three routes supplying the coolant to a throttle body, an exhaust gas recirculation (EGR) valve, and an EGR cooler, merged together on a downstream side of the throttle body, the EGR valve, and the EGR cooler, and is branched into two routes supplying the coolant to an oil cooler and an automatic transmission fluid warmer.

6. The cooling method according to claim 5, wherein a part of the heater route downstream of the heater core is merged with a part of the device route downstream of the oil cooler and the ATF warmer.

* * * * *